US010569379B2

(12) United States Patent
Monaghan et al.

(10) Patent No.: US 10,569,379 B2
(45) Date of Patent: Feb. 25, 2020

(54) VARIABLE REFERENCE BLOCKING APPARATUS AND METHOD OF USE

(71) Applicant: ESSILOR INTERNATIONAL (COMPAGNIE GENERALE D'OPTIQUE), Charenton-le-Pont (FR)

(72) Inventors: James Monaghan, Lake Dallas, TX (US); Bruce Taylor, Dallas, TX (US); Brad Gelb, Dallas, TX (US)

(73) Assignee: ESSILOR INTERNATIONAL, Charenton-le-Pont (FR)

( * ) Notice: Subject to any disclaimer, the term of this patent is extended or adjusted under 35 U.S.C. 154(b) by 492 days.

(21) Appl. No.: 15/109,091

(22) PCT Filed: Dec. 30, 2014

(86) PCT No.: PCT/EP2014/079413

§ 371 (c)(1),
(2) Date: Jun. 29, 2016

(87) PCT Pub. No.: WO2015/101615

PCT Pub. Date: Jul. 9, 2015

(65) Prior Publication Data

US 2016/0325394 A1 Nov. 10, 2016

Related U.S. Application Data

(60) Provisional application No. 61/922,478, filed on Dec. 31, 2013.

(51) Int. Cl.
*B24B 13/005* (2006.01)

(52) U.S. Cl.
CPC ..... *B24B 13/0052* (2013.01)

(58) Field of Classification Search
None
See application file for complete search history.

(56) References Cited

U.S. PATENT DOCUMENTS

| | | | | |
|---|---|---|---|---|
| 3,383,808 A | | 5/1968 | Deshayes et al. | 451/390 |
| 4,372,368 A | * | 2/1983 | Lombard | B24B 13/0052 164/332 |
| 5,785,580 A | | 7/1998 | Cook | 451/42 |

FOREIGN PATENT DOCUMENTS

| | | |
|---|---|---|
| EP | 2255925 | 12/2010 |
| WO | WO 87/05247 | 9/1987 |

OTHER PUBLICATIONS

International Search Report and Written Opinion issued in PCT/EP2014/079413, dated May 7, 2015.

* cited by examiner

*Primary Examiner* — Brian D Keller
(74) *Attorney, Agent, or Firm* — Norton Rose Fulbright US LLP

(57) ABSTRACT

Described is a variable reference blocking apparatus for blocking an optical article (5). The apparatus comprises an adjustable ring unit (11) having a plurality of concentric members (19,19*c*,19*i*) positioned about a central axis. Each concentric member (19,19*c*,19*i*) generally comprises a lip region (17) on its upper end that is capable of receiving at least a portion of a front face of the optical article (5). The apparatus further comprises a moveable base (13) in which its upper portion is coupled with a removable insert (7). The removable insert (7) is generally positioned to be centered about the front face of the optical article (5).

15 Claims, 4 Drawing Sheets

VARIABLE REFERENCE BLOCKING APPARATUS AND METHOD OF USE

CROSS REFERENCE TO RELATED APPLICATION

This Application is a national phase application under 35 U.S.C. § 371 of International Application No. PCT/EP2014/079413 filed Dec. 30, 2014, which claims the benefit of priority to U.S. Provisional Appl. No. 61/922,478 filed Dec. 31, 2013. The entire contents of each of the above-referenced disclosures is specifically incorporated by reference herein without disclaimer.

RELATED FIELD

The invention as described and claimed relates generally to an improved blocking apparatus, method of use for blocking an ophthalmic article or lens, and one or more features that improve the blocking of an ophthalmic article or lens.

BACKGROUND

Methods of producing an ophthalmic lens, particularly as corrective eyewear, generally include first obtaining or removing a suitable right and/or left ophthalmic lens blank from a source of semi-finished products, such as a product store. The term "semi-finished" is used to mean that the ophthalmic lens blanks, which are usually round or oval in plan view, have not yet been edged, and have already been machined or in another way contoured on one of their two optically active faces.

Further machining and/or polishing operations are carried out while holding the lens blank by means of a blocking device attached to one of the faces of the lens blank while a tool operates on the opposite face of the lens blank During this treatment of the surface of the lens blank, or surfacing, the lens blank is repeatedly taken a hold of by a machine.

The lens blanks are then prepared for the blocking operation, namely by applying a suitable protective film or a suitable protective lacquer to protect the optically active face which has already been machined or contoured, i.e. the first face or blocking face.

The machinery that is used to "block" the lens typically includes a blocking support, or a grip block or chuck, a blocking means for receiving and holding a semi-finished lens blank via one of its main faces, and a means for securing the nose of various machine tools or measurement and inspection devices to provide blocking of the lens blank on the machine or the device on the opposite face of the lens blank. Typically, a block is secured onto one of the main faces of the lens blank by casting thereon a fusible molten anchoring material having a low melting temperature (or a polymeric material) in order to enable the lens blank to be subsequently mounted or anchored on the lens holder of a machine, for example, a surfacing machine, an edging machine, or a polishing machine. A suitable type of anchor or fixturing material that may provide the requisite adherence to a lens surface may be a compound having a melting point of around 117° F. (e.g., Alloy 117), comprising approximately 45% bismuth, 23% lead, 8% tin, 5% cadmium, and 19% indium.

There are several disadvantages with current blocking systems. During the blocking of an ophthalmic lens blank, there may be a large number of blocking rings that must be used, depending on the lens blank, and this is cumbersome.

New blocking rings are also being frequently manufactured and added to accommodate new lens products as they become more complex. The blocking rings have to be constantly exchanged for new rings. Another problem with current blocking systems is the need for multiple inserts having different thicknesses, in order to produce a desired thickness of the blocking or anchoring material. Yet another problem with current blocking devices is that existing blocking processes are inefficient and do not allow a user to control the amount of blocking or anchoring material used per lens, thereby resulting in wasted blocking or anchoring material throughout the process.

Thus, there is a need for a simplified, cheaper, automated, and more efficient blocking apparatus and accompanying features that are capable of dynamically changing, such that changing a reference may be based on a single ring and a single insert, so that only one adjustable ring unit and one insert are needed, and that will allow the amount of blocking or anchoring material used in the process to be optimized for more efficient blocking or anchoring use and/or recycling during the blocking process.

SUMMARY

Described herein is an improved blocking apparatus that overcomes the needs described above. The described blocking apparatus generally includes a single adjustable blocking ring and an adjustable base that allows variable positioning of a single insert. The adjustable blocking ring and adjustable base may be housed in an existing or a newly improved blocking apparatus. This allows the blocking device to comprise a single insert to be used with the moveable base. Both features would allow for minimal operating steps and minimal operator skill level during a blocking procedure. The combination of this adjustable ring unit and the moveable blocking base are also useful for eliminating operator error and the need for multiple rings and multiple inserts.

In one or more embodiments is a variable reference blocking apparatus for blocking an optical article. The apparatus comprises an adjustable ring having a plurality of concentric cylindrical members or concentric members. Each of these members may comprise a lip capable of receiving at least a portion of a front face of the optical article. The apparatus may further comprise an adjustable base having an upper portion and a lower portion. The upper portion may be coupled to an insert. The insert may be positioned opposite the front face of the optical article. The plurality of concentric cylindrical members or concentric members may be positioned about a vertical axis. The insert may be positioned about the vertical axis opposite the front face of the optical article. The insert may be capable of being positioned at least partially below at least one of the lips of the cylindrical members or concentric members. The surface of the optical article may be a convex surface. The optical article may be a semi-finished ophthalmic lens blank. The adjustable ring may further comprise a central cavity. The insert may be capable of being positioned at least partially within the central cavity. The apparatus may further comprise a chamber. At least a portion of the cylindrical members or concentric members may be positioned within the chamber. Each of the cylindrical members or concentric members may have a height that is slideably adjustable relative to the other cylindrical members or concentric members. A cavity may be defined between the front face of the lens, at least one lip of the cylindrical member or concentric member, and the front face of the insert. The insert may be removably coupled to the adjustable base. The adjustable base may be capable of being adjusted along at least one of the vertical axis and a horizontal axis. The adjustable base may be capable of being axially tilted about a center of rotation relative to at least one of the vertical axis and the horizontal axis.

Described herein is also a blocking ring apparatus comprising a plurality of concentric individually adjustable cylindrical members or concentric members. Each cylindrical member or concentric member may have a top portion and a bottom portion. The top portion of each cylindrical member or concentric member may comprise a lip configured for contact with at least a portion of an optical article. Each of the cylindrical members or concentric members may be in contact with at least a portion of an adjacent cylindrical member or concentric member. Each of the cylindrical members or concentric members may be slidably adjustable in relation to other cylindrical members or concentric members. The adjustable ring may comprise from about 2 cylindrical members or concentric members to about 15 cylindrical members or concentric members. The shape of the adjustable ring may be spherical, aspherical, oval, and some variation thereof. At least one of the cylindrical members or concentric members may have a height that is different from the height of the other cylindrical members or concentric members.

In additional embodiments is a blocking support comprising an adjustable base having a top portion and a bottom portion. The top portion of the base may be capable of being removably coupled to an insert. The adjustable base may be capable of being actuated along at least one of a vertical axis and a horizontal axis.

In a method of blocking an optical article, the method may include providing a blocking apparatus. The blocking apparatus may comprise an adjustable ring having a plurality of concentric cylindrical members or concentric members positioned about a vertical axis. Each cylindrical member or concentric member may comprise a lip capable of receiving at least a portion of a front face of the optical article. An adjustable base having an upper portion may be coupled to an insert. The insert may be positioned about a vertical axis. The method may further comprise adjusting position of the adjustable ring such that at least a portion of the adjustable ring is in contact with the front face of the optical article. The method may further comprise adjusting position of the adjustable base. A front face of the insert may be positioned opposite the first face of the optical article, thereby defining a cavity. The cavity may be between the front face of the optical article, the front face of the insert, and at least one lip of the adjustable ring. The method may further comprise adjusting at least one of the adjustable base and the adjustable ring about a horizontal axis. The method may further comprise axially tilting at least one of the adjustable base and the adjustable ring relative to at least one of the vertical axis and the horizontal axis. The method may further comprise injecting a blocking material into the cavity. The blocking material may be a molten alloy.

In a method of optimizing an amount of blocking material used in a blocking procedure for an optical article, the method may comprise providing a blocking apparatus. The blocking apparatus may comprise an adjustable ring having a plurality of concentric cylindrical members or concentric members positioned about a vertical axis. Each cylindrical member or concentric member may comprise a lip. The blocking apparatus may further comprise an adjustable base. The adjustable base may have an upper portion coupled to an insert. The insert may be positioned about the vertical axis. The method may further comprise positioning an optical article having a pre-determined curvature. The front face of the optical article may be in contact with at least one lip of the adjustable ring. The method may further comprise adjusting position of the adjustable base such that a front face of the insert is positioned opposite the first face of the optical article, thereby defining a cavity of a pre-determined volume. The method may further comprise injecting a blocking material into the cavity.

Also disclosed herein is a blocking ring unit comprising a plurality of concentric individually adjustable cylindrical members or concentric members, each member having a top portion and a bottom portion, wherein the top portion of each cylindrical member or concentric member comprises a lip configured for contact with at least a portion of an optical article.

Also disclosed herein is a blocking support comprising an adjustable base having a top portion and a bottom portion, wherein the top portion of the base is capable of being removably coupled to an insert, and wherein the adjustable base is capable of being actuated along at least one of a vertical axis and a horizontal axis.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF THE DRAWINGS

The advantages, nature, and various additional features as described herein will appear more fully upon consideration of the illustrative embodiments now to be described in detail in connection with the accompanying drawings. In the drawings like reference numerals denote similar components throughout the views.

DETAILED DESCRIPTION

Figure 1:
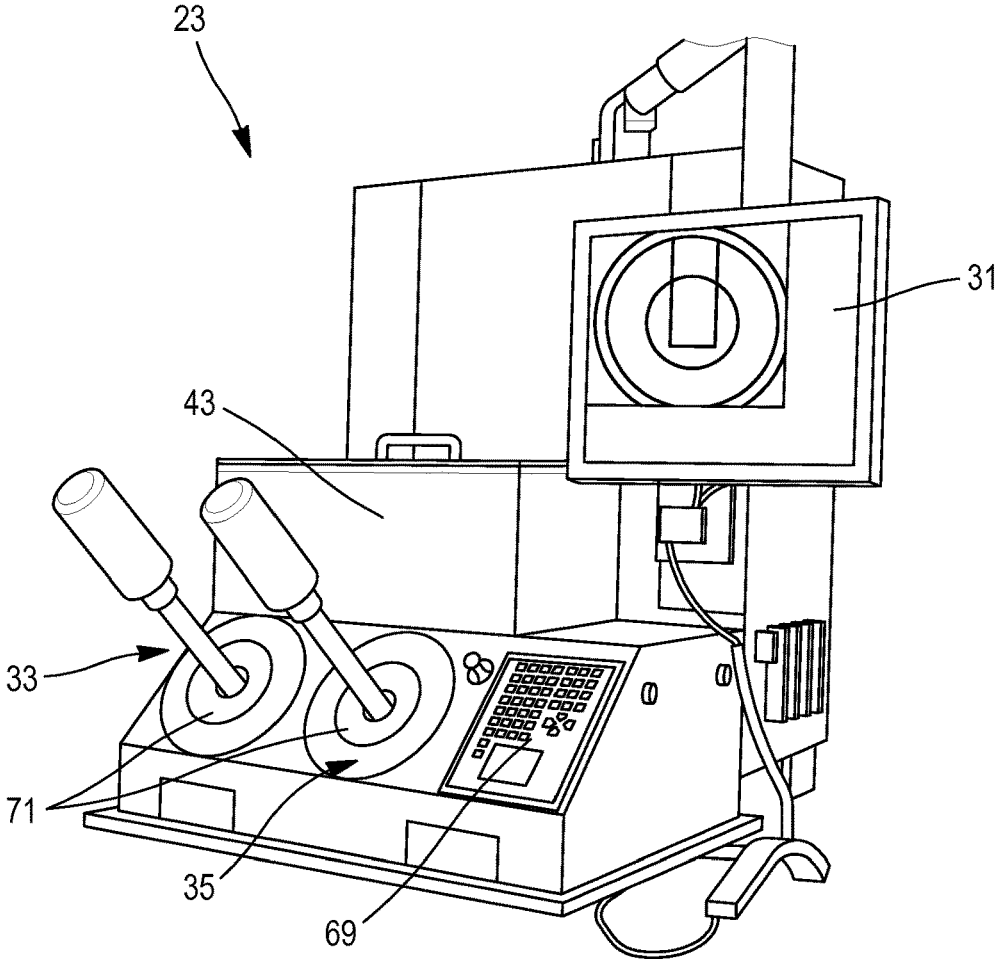
FIG. 1 Prior art
FIG. 1 illustrates a schematic diagram of a blocking machine known in the art.

The words or terms used herein have their plain, ordinary meaning in the field of this disclosure, except to the extent explicitly and clearly defined in this disclosure or unless the specific context otherwise requires a different meaning.

If there is any conflict in the usages of a word or term in this disclosure and one or more patent(s) or other documents that may be incorporated by reference, the definitions that are consistent with this specification should be adopted.

The indefinite articles "a" or "an" mean one or more than one of the component, part, or step that the article introduces.

Whenever a numerical range of degree or measurement with a lower limit and an upper limit is disclosed, any number and any range falling within the range is also intended to be specifically disclosed. For example, every range of values (in the form "from a to b," or "from about a to about b," or "from about a to b," "from approximately a to b," and any similar expressions, where "a" and "b" represent numerical values of degree or measurement) is to be understood to set forth every number and range encompassed within the broader range of values, and including the values "a" and "b" themselves.

Terms such as "first," "second," "third," etc. may be assigned arbitrarily and are merely intended to differentiate between two or more components, parts, or steps that are otherwise similar or corresponding in nature, structure, function, or action. For example, the words "first" and "second" serve no other purpose and are not part of the name or description of the following name or descriptive terms. The mere use of the term "first" does not require that there be any "second" similar or corresponding component, part, or step. Similarly, the mere use of the word "second" does not require that there be any "first" or "third" similar or corresponding component, part, or step. Further, it is to be understood that the mere use of the term "first" does not require that the element or step be the very first in any sequence, but merely that it is at least one of the elements or steps. Similarly, the mere use of the terms "first" and "second" does not necessarily require any sequence. Accordingly, the mere use of such terms does not exclude intervening elements or steps between the "first" and "second" elements or steps, etc.

Herein, the term "lens" means an organic or inorganic lens, preferably an organic lens, comprising a lens substrate which may be coated with one or more coatings of various natures. As used herein, "lens blank" means a transparent medium of a known base curve, with no power, used by optical laboratories, to generate a finished lens with prescribed powers. When finished, the lens may be used for single vision, bi- and tri-focals, progressive additional lenses (PALs), goggles, visors, helmets and the like. While embodiments below illustrate an apparatus and method with a lens blank, it is understood that a more finished lens may also be used with the apparatus and methods described herein, or a further finish to a lens may be provided with the apparatus and methods described herein.

What is presented herein is an improved, simplified blocking apparatus and method of use. The blocking apparatus has certain features including a unitary adjustable ring unit, and an adjustable base which allows for management of an insert height. Said adjustable base and adjustable ring unit are each reusable. In one or more embodiments, the adjustable base and adjustable ring unit are removably fitted to the blocking apparatus.

Figure 2:
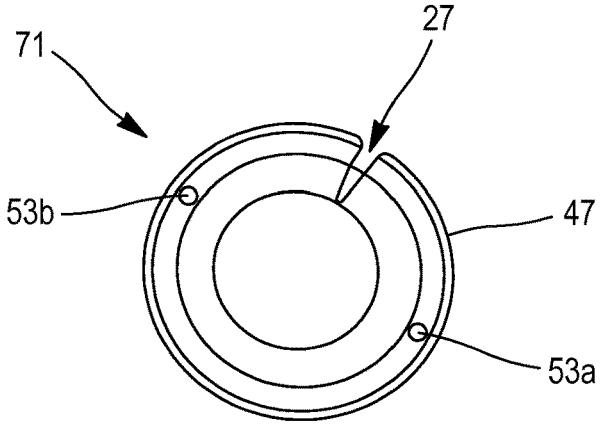
FIG. 2 Prior art
FIG. 2 illustrates a top view of a blocking ring typically used in current blocking procedures.

Referring to FIG. 1, a typical lens blocking machine known in the art is schematically illustrated. An example of such a lens blocking machine may be, but is not limited to, for example, the Satisloh® Layoutblocker-PRA machine (last registered with Satislow AG, Switzerland). Other blocking machines (not pictured) may be used such as those produced by Schneider GmbH. Such machines may have an integrated layout system. In the embodiment illustrated in FIG. 1, one lens may be cooled on a first station 33, while another lens may be adjusted on a second station 35. The position of the lens blank may be secured using a pneumatic pivoting arm (not shown). The blocking machine may also include a tank 43 capable of holding a molten liquid blocking or alloy material. A graphical user interface (GUI) 31 is operably coupled with the blocking machine 23 and is capable of displaying the position of a lens using, for example, x/y coordinates and lens rotation. The machine may also comprise a user input means 69, such as, but not limited to a key pad or touch screen and at least one blocking ring 71 positioned at each of the stations 33, 35, such a blocking ring 71 is illustrated in FIG. 2. Within the blocking machine 23 is positioned an insert (not shown) that is positioned within each ring 71. The insert provides support to the lens during a blocking procedure.

Referring to FIG. 2, a blocking ring 71 is typically circular and composed of stainless steel or brass. The ring 71 typically has an outer rim 47 and two diametrically opposed holes 53*a* and 53*b* spaced apart on the ring to facilitate orientation and securement of the ring 71 to the blocking machine. Additionally, such typical rings characteristically have a supply hole 27 that is capable of receiving a nozzle (not shown) which is used to deliver molten blocking or alloy material to a cavity created between the ring and a lens. Various ring sizes may be found and several may be used, depending on what size lens is being blocked. Each of the rings 71 must be manually placed by an operator on the blocking machine before each lens is blocked. Such rings may be included in a kit of rings of various sizes, available separately or with the blocking machine. Such kits may include two or more rings, ranging in size from about 53 mm diameter to about 68 mm in diameter and with a typical height of about 7 mm.

Figure 3:
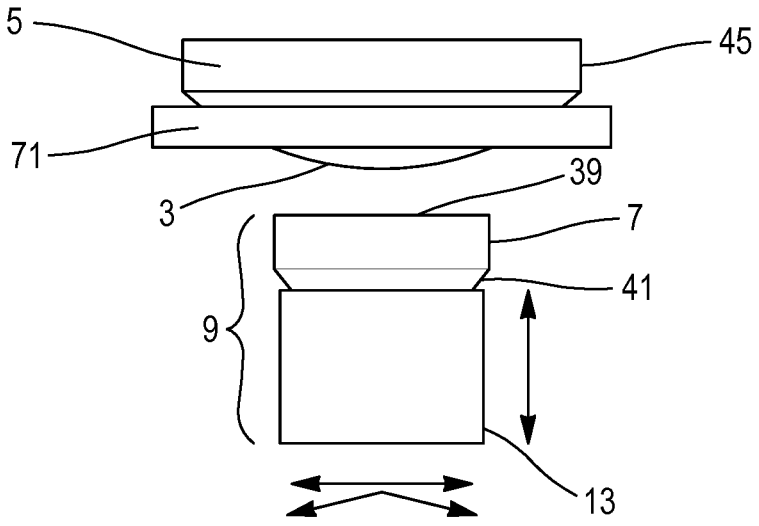
FIG. 3 illustrates a plan view of an adjustable base of a blocking support of the invention in combination with a typical blocking ring.

Referring now to FIG. 3, one embodiment of the described invention is illustrated. In this embodiment, a blocking support 9 comprises an adjustable base 13 and an insert 7. Blocking ring 71 is a typical or conventional blocking ring.

The adjustable base 13 comprises a top portion and a bottom portion. The base 13 may be rigid, cylindrical, and hollow, or it may comprise additional components within, near, or coupled to the adjustable base 13. Alternatively, the adjustable base 13 may be made of any suitable shape or dimension. The adjustable base 13 may be made of a single material, such as, for example, a metal or rigid plastic material. The adjustable base 13 may be positioned about a first central axis (blocking axis), which in some embodiments may be a vertical axis. The adjustable base 13 is adapted to be adjusted. For example, the adjustable base may be adjusted vertically up and down along the vertical, central, or blocking axis, as indicated by the vertical arrows positioned adjacent to the base. The adjustments may be small or may large and may cover a range, for example, from between about 1 cm and about 20 cm, or from 5 cm and about 10 cm, or any range or value therebetween.

Pneumatic means or mechanical components coupled to the adjustable base may be used to actuate the movement of the adjustable base 13. Further, the pneumatic means or mechanical components of the base may be moved either manually or automatically by a programmable means, described below. A controller (not shown) may be used to control the pneumatic means through a user interface, such as for example, a keypad 69, similar to that which is illustrated in FIG. 1. The controller may be operatively connected to a shaft (not shown) that is positioned within the adjustable base 13. The shaft may be capable of moving, orientating, and/or axially tilting the adjustable base 13 around a center of rotation in order to position the insert 7 at a desired location and to define a receiving cavity 37 (FIG. 7) for forming a metal block from a blocking material 29, described herein.

The adjustable base 13 may also be horizontally adjusted along a second, horizontal, or de-centralized axis that is substantially perpendicular to the central axis, which may be a vertical axis, as indicated by the horizontal arrows positioned below the adjustable base 13 (FIG. 3).

The adjustable base 13 may be adjustable along an axis that is axially tiltable or obliquely rotatable relative to at least one of the central axis or vertical axis and its perpendicular or horizontal axis, respectively, along a center of rotation positioned at the intersection of the central axis and its perpendicular axis. In one embodiment, the adjustable base 13 may be adjustable to any angle up to about 45 degrees. Thus, the adjustment angle may be from about 0 degrees to about 45 degrees relative to the horizontal axis, as indicated by the laterally-extending arrows. In practice, one or a plurality of adjustments may be made when manipulating the adjustable base 13, said adjustments arising in any of the directions or adjustment angles described.

The adjustable base 13 described herein could be used and fitted for use with, for example, a Satisloh® blocking machine, or any other type of suitable blocking machine, as known to those of skill in the art, or in a newly designed blocking machine. Retrofitting an existing machine with the described adjustable base 13 may also be performed.

Figure 7:
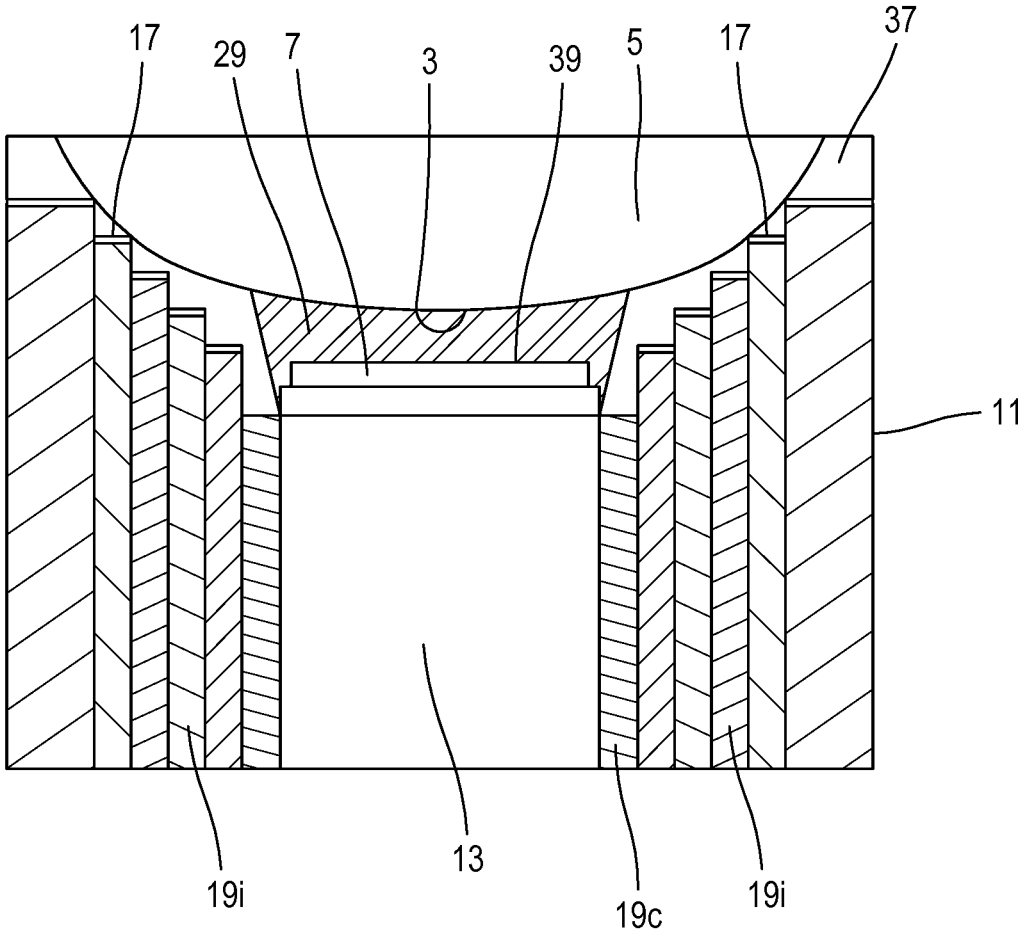
FIG. 7 illustrates a cross sectional view of a portion of the adjustable ring unit of FIG. 6, in relationship to a lens and an adjustable base removably coupled to an insert.

The movement of the insert 7 using the axially adjustable base 13 allows for control of the thickness and/or diameter of the blocking material 29 as depicted in FIG. 7. Thus, by variably positioning the insert 7 to allow variable volumes of cavity 37 to be defined (FIG. 7), the user may control not only the position of the insert 7 but also the amount of blocking material 29 that is used.

The adjustable base 13 combined with the single removable insert 7 is advantageous because it helps reduce operator mistakes and allows for a more automated blocking machine. Because the adjustable base 13 is removably coupled to the insert 7, as the adjustable base 13 is moved by a user, it is possible to use one insert 7 instead of multiple inserts of different thicknesses to achieve a desired thickness of blocking material 29.

In another embodiment an apparatus or system described herein includes a moveable base 13 and an adjustable ring unit 11. One or both of said moveable base and adjustable ring unit described herein may be built into existing blocking machines, such as those described above and illustrated in FIG. 1, or may be configured in a newly designed blocking apparatus, such as an improved blocking apparatus described herein. The adjustable ring unit 11 has some similar functions to a blocking ring, such as blocking ring 71. Use of the term "ring" does not require, however, that this unit have only a ring shape. The adjustable ring unit 11 may be pre-assembled within a portion of a blocking machine, such that a top portion of the adjustable ring unit 11 is visible to the user. Pre-assembly may occur in an existing machine or a new machine.

Referring to FIGS. 4-7, by adjusting the position of the moveable base 13, thereby allowing positioning of the insert 7, the cavity 37 may be better defined, the cavity 37 being formed between an outer face 39 of the insert 7, an outer convex face 3 of lens blank 5, and one or more lips 17 of concentric members 19 of the adjustable ring unit 11. The ability of a user to use one insert 7, having mobility via the moveable and adjustable base 13, allows for a more efficient and cheaper blocking method. Only one insert 7 is needed because the height of the insert 7 may be adjusted via movement of the adjustable base 13, which optimizes the thickness of the blocking material 29, as best illustrated in FIG. 7, and as further described below.

Referring again to FIG. 4, a partial top view of a representative adjustable ring unit 11 is schematically illustrated. The adjustable ring unit comprises an outer edge 55, an inner surface 25, and a plurality of moveable concentric members 19 (also depicted in FIGS. 5 and 6). Each concentric member 19 of the adjustable ring unit 11 comprises a bottom end and a top end comprising a lip 17. The lip 17 is capable of contacting and receiving at least a portion of the convex or front face 3 of the lens blank 5. With a plurality of concentric members, said members surround a central cavity 15. The ring 11 may be a stationary or a moveable ring. The adjustable ring unit 11 is configured to receive a wide range of semi-finished lens blanks 5 that may be produced and of one or more shapes and sized. Receipt of lens blank 5 occurs independent from and regardless of the type of finished face or curvature of said lens.

The adjustable ring unit 11 may be comprised of a suitable material, generally one that is durable. Examples of a durable material are, but are not limited to, stainless steel or other durable metal or metal alloy, or may be a composite material (e.g., composite containing one or more of a plastic, metal, glass, and ceramic) Additional examples of materials that may be used include polystyrene, high heat polypropylene, Celcon (a thermoplastic consisting essentially of ethylene cellulose and plasticizers), and polyalomer (a crystalline thermoplastic polymer produced from two or more different monomer of saturated hydrocarbons). The ring 11 may have any suitable dimension. In one embodiment, the adjustable ring unit 11 is generally of a spherical shape when defined by an outer surface or outer edges 55. In another embodiment, the adjustable ring unit 11 is generally of a polygonal shape. In another embodiment, the adjustable ring unit 11 is generally of an oval or elliptical shape. Any variation of said shapes is also acceptable. In some embodiments, the shape of the adjustable ring unit may generally suit the shape of lens blank 5. Alternatively, the shape of the adjustable ring unit may be sufficient to receive at least a portion of lens blank 5. Said portion being sufficient for blocking said lens blank. The adjustable ring unit 11 will have a height formed by its bottom end and top end. In one or more embodiments, the bottom end and the top end of the adjustable ring unit 11 have the same general shape or geometry. For example, the adjustable ring unit 11 may be formed as a cylinder. In some embodiments, the bottom end and the top end have differing shapes and geometries, such as, for example, when formed into a more conical shape.

Figure 6:
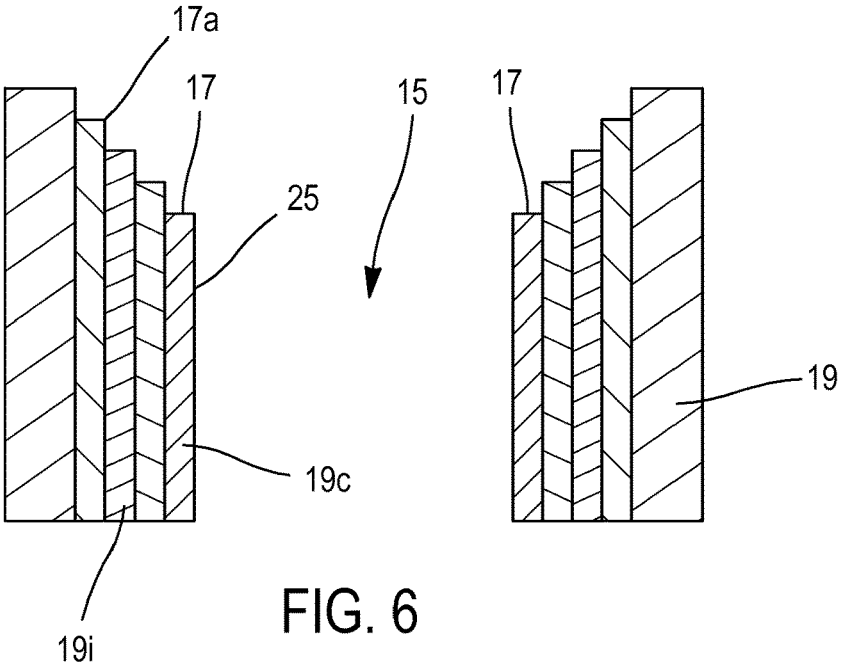
FIG. 6 illustrates a cross sectional view of the adjustable ring unit of FIG. 5.

Each lip 17 may have a similar or independently shaped surface. In one embodiment, the surface of lips 17 is a "tapered" surface that slopes inwardly toward the central cavity 15 of the adjustable ring unit 11. In some embodiments, the surface of lips 17 is a curved surface that may be convex or concave or rounded. In one or more embodiments, jutting edges or corners 17*a* of the lips are further shaped, for example, they may be curved or rounded whether or not the remainder of the lip is so shaped. Alternatively, each lip 17 may have a flat surface such that the lips 17 of adjacent lips would be capable of being flush with each other (FIG. 6). In some embodiments, lips 17 may have a generally flat upper surface and notched or blunted or curved edges 17*a* (not shown). When there are a plurality of lips 17, the outermost lip may have one surface shape while inner lips have a different surface shape. Even further, the innermost lip may have an even differing shape. The lips 17 may be made of the same material as the material used to form the adjustable ring unit 11. The lips 17 may also be comprised of a coating composition or an adhesive composition, such as a polymeric material or a composition comprising one or more materials that provide or enhance a sealing relationship between lips 17 and lens blank 5.

Figure 4:
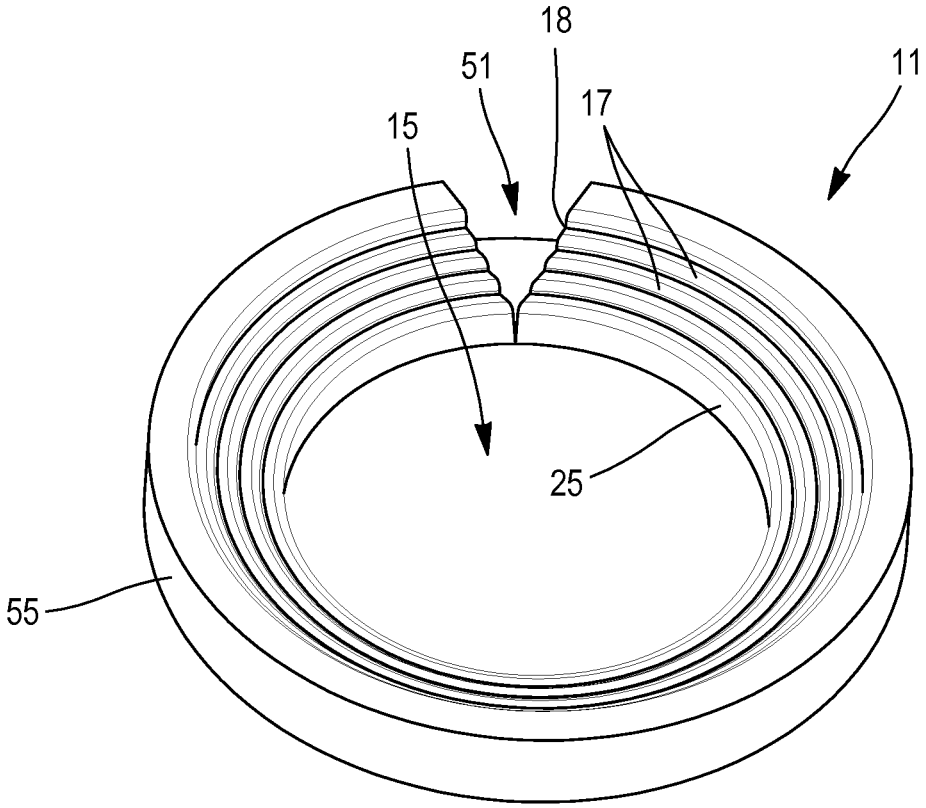
FIG. 4 illustrates a top perspective view of a portion of one embodiment of an adjustable ring unit.
Figure 5:
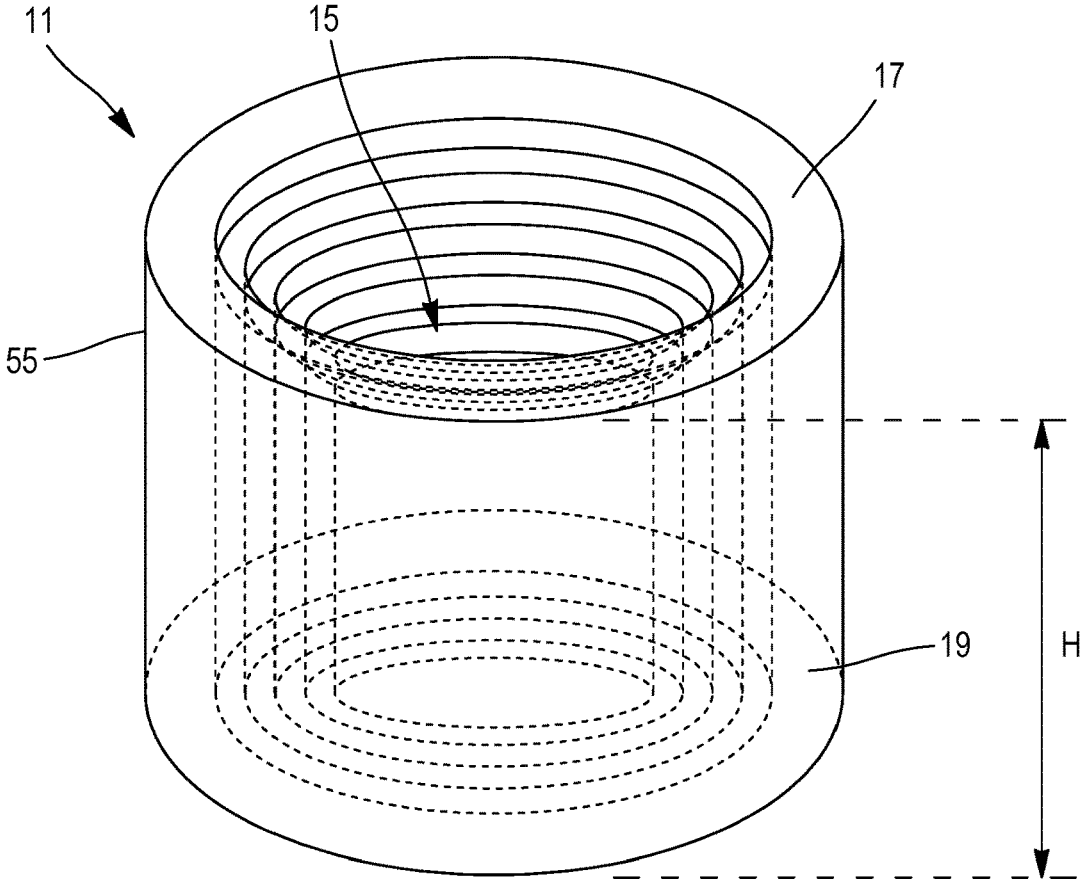
FIG. 5 illustrates an exploded perspective view of an adjustable ring unit.

In some embodiments, with a plurality of lips 17, the lips 17 are positioned in a step-wise arrangement (FIGS. 5 and 6). In some embodiment, one or more of the lips 17 may be conformable to the outer surface of a lens blank 5. Generally, lips may have any desired shape most suitable for contacting at least a portion of the lens blank 5. Each lip may not always contact or be in contact with a surface of the lens blank 5. Similarly, each lip 17 may only have a portion of its surface in contact with a surface of the lens blank 5. Each lip 17 may also be separated by a groove or ridge 18, as depicted in FIG. 4. The groove or ridge 18 when present may be between each lip 17 or between only a portion of the lips 17, such as the innermost lips. The groove or ridge 18 may be of any suitable width and may vary in width, such as from the outermost lips to the innermost lips. In one or more embodiments, such as when the adjustable ring unit 11 has a cylindrical shape, the groove or ridge 18 forms an annular groove.

The concentric members 19 (FIGS. 5 and 6) comprise a first inner centrally disposed concentric member 19*c*, with additional or successive inner concentric members 19*i* extending outwardly from the first inner central concentric member 19*c*. The adjustable ring unit 11 may comprise from 2 to 15 or more concentric members 19. The more concentric members that are provided in an adjustable ring unit 11, the greater the ability to control the volume of the receiving cavity 37 (FIG. 7), and the greater the flexibility in modifying a resulting thickness of blocking material 29. The total diameter and height of the adjustable ring unit 11 may also be adjusted and made to accommodate a lens blank 5 of almost any shape and size. In one or more embodiments, the adjustable ring unit 11 does not have to be removed from the blocking apparatus and replaced with a new ring before, during, or after a lens blocking process, thereby allowing the use of just one adjustable ring unit (i.e., with any number concentric members 19) when blocking a lens blank 5 rather than the use of a number of fixed blocking rings as is conventionally provided.

In one embodiment, the concentric members 19 may be made of stainless steel. The concentric members may be made of other durable materials, such as metals or metal alloys, or may be a composite material (e.g., composite containing one or more of a plastic, metal, glass, and ceramic) Additional examples of materials include but are not limited to polystyrene, high heat polypropylene, Celcon (a thermoplastic consisting essentially of ethylene cellulose and plasticizers), and polyalomer (a crystalline thermoplastic polymer produced from two or more different monomer of saturated hydrocarbons). Concentric rings may be fully integrated into a housing or chamber of the blocking machine, such that they are part of the blocking machine itself.

As is also depicted in FIG. 4, the adjustable ring unit 11 may have an open channel 51. The channel 51 comprises a section substantially in the shape of a notch or may be formed as a circular arc that extends in a radial direction. Channel 51 constitutes a recess occupying a portion of the thickness of the ring, intersecting successively, in the direction from the exterior or outer edge 55 toward the interior of the adjustable ring unit. The channel 51 is capable of receiving a blocking material 29 through a nozzle (not shown) from a source, such as the source 43 described with FIG. 1. The channel 51 positioned on an upper portion of the adjustable ring unit 11 associated with its top end allows the blocking material 29 to flow into receiving cavity 37 (FIG. 7). By defining the cavity, as described further below, the described adjustable ring unit 11 with or without the adjustable and moveable base 13 allows a desired thickness of blocking material 29 to be achieved. The volume of the receiving cavity 37 may be varied depending on the curvature of the lens blank 5, the thickness and chosen height of the insert 7, and the position of the adjustable ring unit 11.

Referring again to FIGS. 5 and 6, representative schematics of the adjustable ring unit 11 are illustrated without depicting channel 51. Although not illustrated, said adjustable ring units may comprise a channel 51 in any of the manners described above. FIGS. 5 and 6 generally depict a bottom portion of the concentric members 19, in which said bottom portions have a flat surface on the bottom end, and in which each of the bottom ends of the concentric members 19 are generally flush and/or coplanar with each other. In an alternative embodiment (not shown), the bottom portion of the concentric members may not all be coplanar or flush with each other. In some embodiments, bottom ends of the concentric members 19 may comprise any desired surface shape or geometry suitable for a blocking machine. In some embodiments, the concentric members may be configured to accommodate another component for a more secure fitting with the blocking apparatus.

In one or embodiments, one or more of the concentric members 19 may be slidably retractable or expandable relative to other concentric members of the adjustable ring unit 11. Generally, said concentric members will, even when slideable with one another, remain associated with one another as a whole or as a unit. The slideable motion is generally linear and in a direction along a plane that is generally parallel with the height H of the adjustable ring unit 11 as illustrated in FIG. 5. Any of the concentric members 19 may be retracted or expanded against any of the other concentric members 19, thereby when in a retracted position exposing at least one adjacent concentric member 19. In some embodiments, the concentric members 19 of the adjustable ring unit 11 may be pneumatically coupled or may be threadedly coupled together or to at least a neighboring member to facilitate movement of the concentric members with respect to each other. The concentric members 19 are, therefore, capable of being moved with respect to each other. Such movement may be provided by one or more of air pressure, hydraulics, gears, and threads positioned between one or more of the concentric members 19. In one example, some of the concentric members may be stationary while other members may be moveable. Alternatively, all of the concentric members may be adjustable. Still further, only of the concentric members may be stationary while the remaining concentric members are moveable. In addition, only one of the concentric members may be moveable or adjustable while the remaining concentric members are stationary.

The adjustable ring unit 11 generally includes a central or blocking axis for positioning of a lens blank 5. Adjustment of the adjustable ring unit 11 when positioning with respect to the lens blank may include adjustments of the ring 11 along its vertical axis or its horizontal axis. Said adjustments may be made independent from one another, similar to the adjustment for the adjustable base 13 and insert 7, as described above. In addition, the adjustable ring unit 11 is designed to allow an adjustment in the percentage of the adjustable ring unit 11 that is in contact with the surface 3 of a lens blank 5. This is provided by the retraction and/or expansion of one or more concentric members as described above.

In some embodiments, the adjustable ring unit 11 is circular in its overall shape, as defined by outer edge 55. In some embodiments, the adjustable ring unit is oval in its overall shape, as defined by outer edge 55. The latter may, in some embodiments, reduce the risk of the blocking material 29 being cut. Generally, as described previously, the adjustable ring unit 11 may be any desired shape or size suitable for use with a lens blank.

As illustrated in the cross-sectional view of FIG. 6, each of the concentric members 19 may vary in height and diameter (e.g., having a width or total cross sectional diameter of 72 mm, 68 mm, or 63 mm) Each concentric member may also be adjusted to be moveable between a range of heights. The total height of the adjustable ring unit 11 may be defined by any one of the concentric members 19. The overall height may be adjusted by moving at least one concentric member 19 with respect to the other concentric members 19. A user input means (e.g., input 69 as described with FIG. 1) may be used to control which concentric member 19 of the adjustable ring unit 11 is slidably adjusted relative to the other concentric members 19. Any one of the concentric members 19 may be vertically moved (expanded or retracted) when adjusting the adjustable ring unit 11. Thus, it is possible to position the lip 17 of one or more concentric members 19 such that said one or more lips 17 is more prominent in height in relation to the others on neighboring concentric members 19, thereby defining an overall shape and, hence, providing a modified diameter, serving as a working or supporting diameter of the adjustable ring unit 11 for a particular lens blank 5. Generally, the first inner concentric member 19*c* may be used to define a smallest cross-sectional diameter of the adjustable ring unit 11. One or more other concentric members may be used to define an outer working or supporting diameter for blocking.

Typical cross-sectional diameters of the adjustable ring unit itself may range from between about 20 mm and about 100 mm, or between about 30 mm and between about 90 mm, or between about 35 mm and about 85 mm, or between about 53 mm and about 72 mm in diameter. One skilled in the art will recognize that any other suitable diameter or range of diameters may be obtained and used with the adjustable ring units described herein. Said absolute diameter may depend on the blocking machine used, on the adjustable base, on the insert, and/or on the lens blank 5. In some embodiments, the moveable blocking support 9 may be used to minimize the number of concentric members 19 used in the adjustable ring unit 11, as well as to position the insert 7 in a desired location.

A desired profile of the adjustable ring unit 11 may be selected by and/or provided for based on a curvature of the lens blank 5 to be blocked. Generally, the profile of the adjustable ring unit 11 is defined by an overall profile of the concentric members 19, as well as the profile of lips 17. This provides an ability to adjust the ring 11 to a desired shape or position in order to accommodate a particular lens curvature. Further, it may allow a user to optimize the amount of blocking material 29 used and minimize the amount of material reclaimed during each blocking cycle. This increases efficiency and minimizes an overall amount of blocking material 29 used per lens. Thus, the invention described herein also comprises a method for controlling and reducing the amount of blocking material used per lens and the amount of blocking material that is necessary to be reclaimed in a blocking process. By providing an ability to adjust the position of the adjustable ring unit (e.g., the position of one or more of the concentric members) and/or the insert 7 as well as or optionally adjusting the adjustable base, there is a decrease in the amount of blocking material lost, such as through dirt or flaking.

As illustrated in FIG. 7, the lips 17 of the adjustable ring unit 11 are positioned between the lens blank 5 and the insert 7. At least a portion of the adjustable ring unit 11 is configured to receive a portion of the lens blank 5 for blocking, such that a portion of at least one of the lips 17 is in contact with the front or convex face 3 of the lens blank 5. Although a lens blank 5 of a certain curvature is illustrated, lenses or lens blanks of any curvature may be used. The lens blank 5 depicted in FIG. 7 generally has a convex front face 3 and a concave back face (not shown) connected by an edge 45 (depicted in FIG. 3). In FIG. 7, only a portion of the lens blank 5 is positioned on a portion of the adjustable blocking ring unit 11. The positioning is such that the lens blank 5 is substantially centered. Although the lens blank 5 illustrated has a spherical shape, the lens may have any suitable shape, such as, but not limited to, aspherical, toric, atoric, oval, polygonal, and any combination thereof.

Upon positioning of the lens blank 5 with the adjustable ring unit 11, at least a portion of a lip 17 of a concentric member 19 is capable of adhering to or becoming sealingly engaged with the front or convex surface 3 of the lens blank 5 during the blocking process. The size of the lens determines which concentric member(s) 19 of the adjustable ring unit 11 will be chosen to be sealingly engaged with the outer surface or the front or convex face 3 of the lens blank 5. For example and with reference to FIGS. 4-7, a lens blank 5 having a larger diameter will become sealingly engaged with a lip 17 of a concentric member 19 that is positioned nearer or is at the outer edge 55 of the adjustable ring unit 11. A lens blank 5 having a smaller diameter will become sealingly engaged with a lip 17 of an inner concentric member 19*i* of the adjustable ring unit and/or a first inner central concentric member 19*c*.

The selection of the adjustable height and diameter of the adjustable ring unit 11 may be entered manually or may be determined by the blocking machine itself or through an external unit. For example, an external unit could be a lab management system (LMS) as is understood in the art, or a database that is capable of communicating with the blocking machine or another type of machine that may make a determination of the height and/or working diameter of the adjustable ring unit 11 using some data points entered or stored in the LMS or the database. The blocking machine may also comprise software which could be directly installed into or integrated with the blocking machine. Any existing blocking machine could be redesigned or modified accordingly to accommodate the adjustable base 13 and/or the adjustable ring unit 11 with or without the LMS, database and/or accompanying software.

During blocking of any lens blank, the lens blank is joined to a suitable lens block piece of a lens block apparatus, such as any described herein or suitable for use as described herein. Blocking may be performed in accordance with manufacturing standards, such as one set as German standard DIN 58766. Generally and in brief, a lens block piece is first brought into a predefined position with respect to a first or front convex face of the lens blank During the blocking operation, the lens blank is initially pressed via its convex face against at least a portion of the adjustable ring unit described herein, such as adjustable ring unit 11 as illustrated in FIG. 7, so as to cooperate with the central cavity 15 of the adjustable ring unit as depicted in FIG. 4. In a manner described above, the lens blank is blocked so as to enable its concave face to be surfaced. It is therefore necessary to hold the lens blank via its convex face. An insert, such as insert 7 depicted in FIG. 7, is positioned to be in relation with the convex face 3 of the lens blank 5, which is the surface of the lens black 5 that faces the inert 7. Generally, the insert 7 must be positioned a certain predetermined distance (in mm) from the lens blank 5. In some embodiments, the insert 7 is held in place by gravity to form a secure fit with adjustable base 13.

Still referring generally to FIGS. 6 and 7, the front or convex face 3 of the lens blank 5 is brought to bear against and to contact at least a portion of the lips 17 of one or more concentric members 19 of the adjustable ring unit 11 in order to cooperate with the central cavity 15 of the adjustable ring unit 11. A holding arm (not shown) has a free end that is capable of residing on or providing a type of weight on the lens blank 5 to keep it in place. This holding arm may be moved between an open position, in which the free end of the arm is at a distance away from the adjustable ring unit 11 and lens blank 5, and a closed position, in which the free end of the holding arm may bear against the lens blank 5, pressing at least a portion of the convex face 3 of lens blank 5 against at least a portion of the adjustable blocking ring unit 11. The insert 7 is positioned in the cavity 15 of the adjustable ring unit 11, generally centered within the cavity 15 so that its upper surface 39 of insert 7 opposes the front or convex face 3 of the lens blank 5. When the lens blank 5 is secured in place, the receiving cavity 37 is defined at least between the front or convex face 3 of the lens blank 5, the front face 39 of the insert 7, and the lips 17 of the concentric members 19 of the adjustable ring unit 11.

A blocking material may then be introduced into this cavity 37 via a channel, such as channel 51 of FIG. 4. The channel lies over or above the cavity 37, generally on an upper end or upper portion of the adjustable ring unit 11. Entry of the blocking material into the cavity may be facilitated by gravity and/or by additional pressure. A reservoir (such as from source 43 as depicted in FIG. 1) is operably coupled with the cavity 37, generally by a hose (not shown) that has a nozzle or other suitable component on one end. The nozzle is operably coupled with or is connected to the channel 51. A control unit (not shown) may control the supply of blocking material to the cavity 37 from its source or reservoir. Upon flow of the blocking material into the cavity, such as cavity 37 of FIG. 7, the blocking material is allowed to solidify, thereby forming a lens block onto the lens blank. The blocking material 29 may be of any suitable type. Examples include those previously described, such as a molten fusible metal alloy, a metal alloy, wax (e.g., Alloy 117), or other polymeric or composite blend. The blocking material may also be an organic adhesive material having a reduced metal content or no metal content. Because of the adjustable height of the insert 7 described herein, only one insert 7 is necessary in order to accomplish the described blocking process, irrespective of the size of the lens blank that is being blocked. Once the blocking material has solidified, the lens block forms a holder or support for machining the second face of the lens blank.

The cavity, referenced as cavity 37 in FIG. 7, is thereby defined by the lens blank 5, the adjustable ring unit 11, and the insert 7. Said elements, alone or in any combination, allow for suitable modifications to the blocking material 29 as depicted in FIG. 7. As such, a desired thickness of the blocking material 29 may be provided for and so molded in view of the adjustments made to any one or more of the lens blank 5, the adjustable ring unit 11, and the insert 7, as well as or in addition to the amount that flows into the cavity 37. Upon solidification of the blocking material 29, there is adherence of the blocking material 29 with the insert 7, and adherence of the blocking material 29 with the lens blank 5. A chuck other suitable coupling means provided by the blocking machine may then suitably couple with the insert 7, so that insert 7 associated with blocking material 29 and the lens blank 5 remain in position during the finishing steps, such as profiling, edging, or other surfacing steps that may be performed on the lens blank 5. Transfer of the lens blank 5 to another machine (e.g., profiling machine, edging machine, grinding machine, surfacing machine) will include transfer of the insert 7 and blocking material 29, thereby preventing damage to the lens when finishing said lens. In some embodiments, the adjustable blocking ring unit 11 with the blocked lens blank 5 are removed from the blocking machine and the blocked lens blank is then allowed to set before de-blocking and mounting in other machines, such as surfacing, profiling, and/or edging machines.

Adjustment of the adjustable base 13 and insert 7 as well as the adjustable ring unit 11 may be actuated by a programmable means. The programmable means may comprise one or more of a processor, a computer software program, and a graphical user interface (GUI) such as a display screen 31. This system may but does not need to rely on operator input. Instead, in some embodiments, instructions and data for a blocking job may be provided by an LMS or an operable calculator (e.g., prescription calculator, lens calculator, conversion calculator, etc.) or other suitable means for delivering content and information, including features and methodologies described herein. When the blocking machine receives instructions from the programmable means, the adjustable ring unit 11 may be adjusted to a particular height and diameter, and the base 13 that is removably and operably coupled with insert 7 may be adjusted to a desired position. Said instructions may be predetermined, and may be automated. In one or more embodiments, data and/or instructions for the programmable means may be sent to the blocking machine automatically instead of manually by a user, thereby eliminating the need for time-consuming manual steps, reducing the chance of operator error, increasing efficiency, and lowering manufacturing costs.

In one or more embodiments, blocking instructions may be programmed into an external unit or a prescription (Rx) calculator, such as, for example, an SCG, which is capable of calculating the Rx to be provided to the back side of a lens blank Information may be sent (input) from the programmable means through the blocking machine to the adjustable ring unit 11 to choose or select an appropriate or specific diameter and height for the adjustable ring unit 11 during one or more blocking procedures. In another embodiment, blocking data may be sent to the blocking machine from the blocking machine itself or from an external unit. In yet another embodiment, blocking instructions may be sent to the blocking machine itself, and the blocking machine is capable of interpreting the data that is provided. Certain heights and diameters of the concentric members for a particular adjustable ring unit in accordance with a specific lens blank may be predefined, and may be obtained from a separate database that contains such information.

In still another embodiment the blocking process may be modularized, and the Rx calculations may be split or separated from the remainder of the blocking process, so the Rx calculator may be capable of functioning with any type of blocking machine. This modularization system could complement a stand-alone blocking system. The blocking instructions may be programmed in a calculator or a database, or the blocking machine may directly perform the calculations. The calculation data is capable of being delivered to the blocking machine and is not dependent on an operator correctly executing instructions regarding ring height, lens blank radius, and optimal blocking material thickness.

In one embodiment, blocking data may be acquired using captured digital images that are then processed by a processor. Based on values obtained from the captured digital images, the chamber (or the adjustable base when included) of the blocking machine holding the insert (similar to an insert 7 as described herein) may be correctly positioned (e.g., vertically up or down and/or horizontally and along the central axis) to increase or decrease the distance between the insert 7 and the lens blank 5. With pre-programmed instructions, the blocking machine may be capable of managing the vertical and/or horizontal reference positioning of the insert, allowing the blocking step to be easily and cheaply as well as repeatedly automated.

With the features described herein, there are several benefits. One benefit is that the user does not need to use multiple blocking rings. This is because the adjustable ring unit described herein is adaptable to a variety of lens blanks shapes and sizes and may be fitted to any number of blocking machines. The adjustable ring unit described herein when positioned in a blocking machine will allow all manufactured lens products to be blocked using the same adjustable ring unit. Thus, one adjustable ring unit may be configured for and built for a particular machine and eliminates the necessity to fully machine a number of parts (e.g., block pieces, rings, inserts) for one machine. The described adjustable ring unit design thus allows a cost reduction in ring investment per pair of lenses per blocking machine.

The features described eliminate errors that may occur with user input, due to operator errors, and with ring selection. Current rings anticipate user error. Each ring is marked with a marking so the user may confirm that the correct ring is used. This invention eliminates the need to have each ring marked to anticipate user error. This described features and system also eliminate the chance that a ring may become damaged during repeated removal and then later use of the same ring. The adjustable ring unit described herein also reduces potential defects associated with repeatedly removing and replacing a lens blank, by requiring only one insert, there is now the ability to complement a proposed stand-alone blocking calculation system.

Another benefit described herein is that with the universal features described herein, a more cost effective blocking machine may be provided for customers, one that may still be automated and commercially available as compared with more specialized machines that currently require specialized parts and a plurality of block pieces, inserts, and/or rings. With the features and apparatus described herein, new products may be developed in a shorter period of time because several custom pieces (e.g., having different curvatures, sizes, and/or surface lines) are no longer necessary, thus, there is no need to fit the machine and use a different ring (or different insert) for each new lens product. Only one insert is required for any blocking system employing the features described herein. Further, this eliminates the need to generate specific blocking data during new product development.

A further benefit of this system include the fact that the adjustable base and the adjustable ring unit may each be manufactured as a stand-alone component, or said features may be built directly into a blocking machine (new or existing), thus said features may be retrofitted into an existing blocking machine or provided as a newly designed blocking machine.

The particular examples disclosed above are illustrative only, as the described invention may be modified and practiced in different but patentably equivalent manners apparent to those skilled in the art having the benefit of the teachings herein. It is, therefore, evident that the particular illustrative examples disclosed above may be altered or modified and all such variations are considered within the scope of the present invention.

The various elements or steps according to the disclosed elements or steps may be combined advantageously or practiced together in various combinations or sub-combinations of elements or sequences of steps to increase the efficiency and benefits that may be obtained from the invention.

It will be appreciated that one or more of the above embodiments may be combined with one or more of the other embodiments, unless explicitly stated otherwise.

The invention illustratively disclosed herein suitably may be practiced in the absence of any element or step that is not specifically disclosed or claimed.

Furthermore, no limitations are intended to the details of construction, composition, design, or steps herein shown, other than as described in the claims.

What is claimed is:

1. A variable reference blocking apparatus adapted to blocking an optical article comprising:

an adjustable ring unit comprising a plurality of concentric members positioned about a cavity comprising a central axis, each concentric member comprising a single unitary cylindrical body, having a lip region capable of receiving at least a portion of a front face of the optical article, and capable of moving along the central axis, wherein one or more concentric members of the plurality of concentric members have a contiguous circumference for at least a portion of a length thereof;

a moveable base for supporting a block, the moveable base comprising an upper portion and a lower end, and the moveable base positioned and moveable within the cavity; and an insert removably coupled with the upper portion of the moveable base, such that a first contacting surface of the insert opposes the front face of the optical article.

2. The variable reference blocking apparatus of claim 1, further comprising a chamber, wherein at least upper portions of the concentric members are positioned within the chamber.

3. The variable reference blocking apparatus of claim 1, wherein the moveable base is moveable with respect to the central axis in a direction that is any one of vertical, horizontal with respect to the central axis, and axial along the central axis.

4. The variable reference blocking apparatus of claim 1, wherein one of more concentric members of the plurality of concentric members of the adjustable ring unit further define a channel for entry of a hardenable blocking material.

5. The variable reference blocking apparatus of claim 1, wherein one or both of the adjustable ring unit and moveable base are moveable with respect to each other.

6. The variable reference blocking apparatus of claim 1, wherein one or more of the plurality of concentric members are slideable with respect to each other.

7. The variable reference blocking apparatus of claim 1, wherein the plurality of concentric members comprises from 2 concentric members to 15 concentric members, wherein at least one lip region is configured to contact at least the portion of the front face of the optical article, and wherein each lip region corresponds to a top portion of the corresponding concentric member.

8. The variable reference blocking apparatus of claim 1, wherein a shape of an exterior of the variable reference blocking ring apparatus is selected from the group consisting of spherical, aspherical, and oval, and wherein one or more the lip regions are configured for releasably sealing with the block.

9. The variable reference blocking apparatus of claim 1, wherein a first lip region of a first concentric member of the plurality of concentric members is separated by a groove or ridge from a second lip region of a second concentric member of the plurality of concentric members.

10. The variable reference blocking apparatus of claim 9, wherein the groove or ridge comprises an annular groove.

11. The variable reference blocking apparatus of claim 1, wherein each lip region of the plurality of concentric members is separated by a groove or ridge from an adjacent lip region of the plurality of concentric members.

12. The variable reference blocking apparatus of claim 1, wherein the lip region of at least one concentric member of the plurality of concentric members comprises a coating of the at least one concentric member.

13. The variable reference blocking apparatus of claim 1, wherein, when the moveable base is positioned for use, a filling space is defined between the front face of the optical article, at least one lip region of the plurality of concentric members, and the first contacting surface of the insert, the filling space configured to receive hardenable blocking material to form the block.

14. A method of blocking an optical article, wherein the method comprises:

providing a variable blocking apparatus comprising:

an adjustable ring unit comprising a plurality of concentric members positioned about a cavity comprising a central axis, each concentric member comprising a single unitary cylindrical body, having a lip region capable of receiving at least a portion of a front face of the optical article, and capable of moving along the central axis;

a moveable base for supporting a block comprising an upper portion and a lower end, the moveable base positioned and moveable within the cavity; and an insert removably coupled with the upper portion of the moveable base;

adjusting position of the adjustable ring unit such that at least a portion is in contact with the front face of the optical article;

adjusting position of the moveable base such that a first contacting surface of the insert is positioned to oppose the front face of the optical article, thereby defining a filling space for entry of a hardenable blocking material, the filling space defined by the front face of the optical article, the first contacting surface of the insert, and at least one lip region of the adjustable ring unit, providing the hardenable blocking material into the filling space; and forming a block from the hardenable blocking material in the filling space.

15. The method of claim 14, further comprising axially tilting at least one of the moveable base and the adjustable ring unit relative to the central axis.

* * * * *